US009282839B2

(12) United States Patent
Rakhamimov et al.

(10) Patent No.: US 9,282,839 B2
(45) Date of Patent: Mar. 15, 2016

(54) HANGER

(71) Applicants: Murad Rakhamimov, Mountain View, CA (US); Driven Innovation LRV, Inc., Fremont, CA (US)

(72) Inventors: Murad Rakhamimov, Mountain View, CA (US); Eugene Vicknair, Fremont, CA (US); Ben Roth, Fremont, CA (US); Tom Lin, Fremont, CA (US); Victor Lazzaro, Fremont, CA (US)

(73) Assignees: Murad Rakhamimov, Mountain View, CA (US); Driven Innovation LRV, Inc., Fremont, CA (US)

( * ) Notice: Subject to any disclaimer, the term of this patent is extended or adjusted under 35 U.S.C. 154(b) by 0 days.

(21) Appl. No.: 14/808,160

(22) Filed: Jul. 24, 2015

(65) Prior Publication Data

US 2016/0022077 A1 Jan. 28, 2016

Related U.S. Application Data

(60) Provisional application No. 62/028,370, filed on Jul. 24, 2014.

(51) Int. Cl.

| | |
|---|---|
| ***A41D 27/22*** | (2006.01) |
| ***A47G 25/44*** | (2006.01) |
| ***A47G 25/14*** | (2006.01) |

(52) U.S. Cl.

CPC ..... *A47G 25/441* (2013.01); *A47G 25/1442* (2013.01)

(58) Field of Classification Search

CPC ..... A47G 25/1442; A47G 25/1471; A47G 25/186; A47G 25/28

USPC ..... 223/88, 87

See application file for complete search history.

(56) References Cited

U.S. PATENT DOCUMENTS

| | | | | |
|---|---|---|---|---|
| 2,461,179 | A | 2/1949 | Rogalla | |
| D173,676 | S | 12/1954 | Perrin | |
| 2,884,171 | A | 4/1959 | Knuth | |
| 2,954,150 | A | 9/1960 | Pace | |
| 3,002,662 | A | 10/1961 | Albright | |
| 3,276,645 | A | 10/1966 | Buzzelli | |
| 4,529,110 | A | 7/1985 | Tate | |
| 5,044,535 | A | 9/1991 | Hunt | |
| 5,071,045 | A * | 12/1991 | Hollis | A47G 25/34 223/85 |
| 5,598,957 | A | 2/1997 | Bell | |
| 6,050,461 | A * | 4/2000 | Batts | A47G 25/485 223/85 |
| 6,206,255 | B1 | 3/2001 | Turner | |

(Continued)

FOREIGN PATENT DOCUMENTS

| | | | | |
|---|---|---|---|---|
| EP | 1842462 | A1 * | 10/2007 | A47G 25/1442 |

*Primary Examiner* — Nathan Durham

(74) *Attorney, Agent, or Firm* — Polson Intellectual Property Law, PC; Margaret Polson

(57) ABSTRACT

In one embodiment a hanger has two interlocking regions, each located at the lower corners of the hanger arms. The interlocking regions have a hole that extends at least part way through the body of the hanger and an extruded lip that extends beyond the body of the hanger at the interlocking region. In one embodiment the outer surface of the interlocking region is narrower than the upper hanging arms of the hanger and the outer edge of the extruded lip is substantially co-planar with the outer surface of the upper hanging arms. This allows the upper hanging arms to be in direct contact with each other when the two hangers are locked together, creating a smooth upper surface.

6 Claims, 5 Drawing Sheets

(56) References Cited

U.S. PATENT DOCUMENTS

| | | | | |
|---|---|---|---|---|
| 6,243,923 | B1 * | 6/2001 | Hamilton | B65H 75/20 223/88 |
| 7,097,081 | B2 | 8/2006 | Frassinelli | |
| D527,536 | S * | 9/2006 | McCoy | D6/319 |
| 7,938,300 | B2 * | 5/2011 | Diamond | A47G 25/183 223/85 |
| 8,016,170 | B2 | 9/2011 | Johnson et al. | |
| D656,325 | S * | 3/2012 | Ho | D6/319 |
| 8,286,842 | B2 | 10/2012 | Carey | |
| 8,459,514 | B2 | 6/2013 | Lagzdins | |
| 2008/0257919 | A1 * | 10/2008 | Yamada | A47G 25/20 223/85 |
| 2012/0080458 | A1 * | 4/2012 | Kimpton | A47G 25/34 223/85 |
| 2012/0080460 | A1 | 4/2012 | Nance, Jr. | |
| 2012/0138641 | A1 * | 6/2012 | Yamada | A47G 25/1442 223/85 |

* cited by examiner

HANGER

CROSS REFERENCE APPLICATIONS

This application is a non-provisional application claiming the benefits of provisional application No. 62/028,370 filed Jul. 24, 2014, which is hereby incorporated by reference for all purposes.

BACKGROUND

Clothing hangers are well known in the art. It is desirable to have clothing hangers with a relatively thin width, so that a large number of hangers can fit in a given length of hanging rod. Additionally, a thinner width means that less material is used to make the hanger, creating cost savings in manufacturing, shipping and storing the hangers. However, a hanger with a thin width almost always bends more easily when a heavy item is hung on it and/or can create undesirable crease lines in the clothing hanging on them.

The foregoing example of the related art and limitations related therewith are intended to be illustrative and not exclusive. Other limitations of the related art will become apparent to those of skill in the art upon a reading of the specification and a study of the drawings.

SUMMARY

One aspect of the present disclosure is to provide a hanger that can attach to a substantially identical hanger to create a thicker hanger that is less likely to bend and less likely to create creases in clothing hung on the hanger.

In one embodiment of the present disclosure, the hanger can interlock with a substantially identical hanger in at least one interlocking region.

In other embodiments, the hangers are joined together with one or more attachment pieces that can be removed from the hanger when not in use.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

In one embodiment a hanger has two interlocking regions, each located at the lower corners of the hanger arms. The interlocking regions have a hole that extends at least part way through the body of the hanger and an extruded lip that extends beyond the body of the hanger at the interlocking region. In one embodiment the outer surface of the interlocking region is narrower than the upper hanging arms of the hanger and the outer edge of the extruded lip is substantially co-planar with the outer surface of the upper hanging arms. This allows the upper hanging arms to be in direct contact with each other when the two hangers are locked together, creating a smooth upper surface.

In another embodiment, two hangers are locked together with separate joining pieces. Multiple different joining pieces can be used to allow the user to create multiple different configurations of the joined hangers for different uses.

In any of the embodiments, the hanger and/or the connection pieces can all be formed of the same material, most likely a suitable plastic, or can be made of two or more different materials. In one example, the hanger connecting feature might be formed of a soft over molded rubber or a separate attached rubber part, thus allowing the softer rubber part to either fit over or inside the mating feature on the other opposite side of the hanger, locking the two hangers together.

In addition to the exemplary aspects and embodiments described above, further aspects and embodiments will become apparent by reference to the accompanying drawings forming a part of this specification wherein like reference characters designate corresponding parts in the several views.

Figure 1:
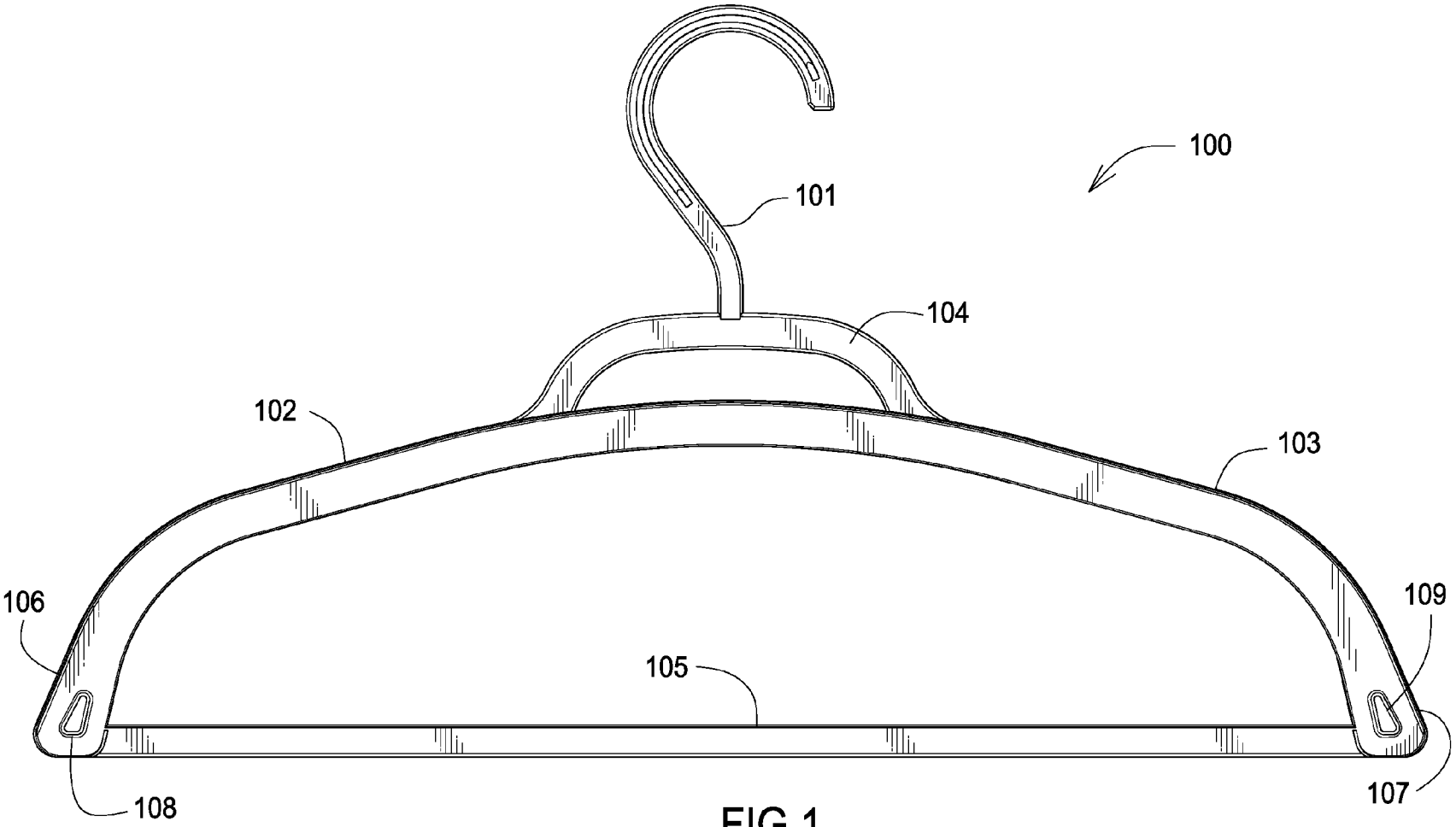
FIG. 1 is a front elevation view of the first embodiment.
Figure 3:
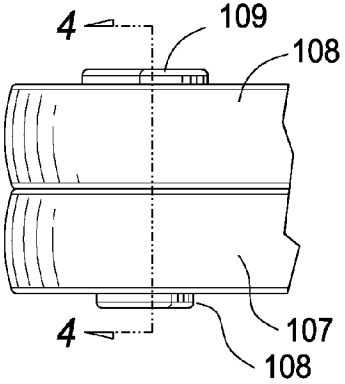
FIG. 3 is a close up view of the interlocked region of the two hangers from the top surface.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Referring first to FIGS. 1 through 6, a hanger 100 has a rail hook 101 to allow the hanger 100 to attach to a clothes rail. The rail hook 101 can be a number of different sizes and shapes to fit on different clothes rail, no limitation to the depicted embodiment in intended or should be inferred. The rail hook 101 is attached to upper arms 102, 103. The rail hook 101 can be attached through an intermediary section 104 or directly to upper arms 102, 103 (not shown). The upper arms 102 and 103 form the hanging surface for the majority of clothes hung on the hanger 100. A bottom member 105 can be provided that extends between the lower ends 106, 107 of the upper arms 102, 103. As is well known in the art, the bottom member is not required.

Figure 4:
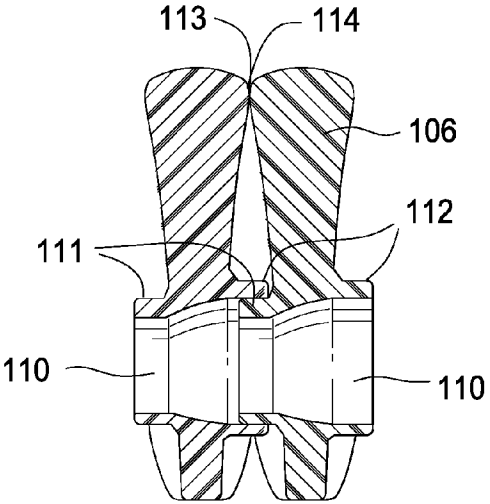
FIG. 4 is a cross sectional view taken along line 4-4 of FIG. 3.
Figure 5:
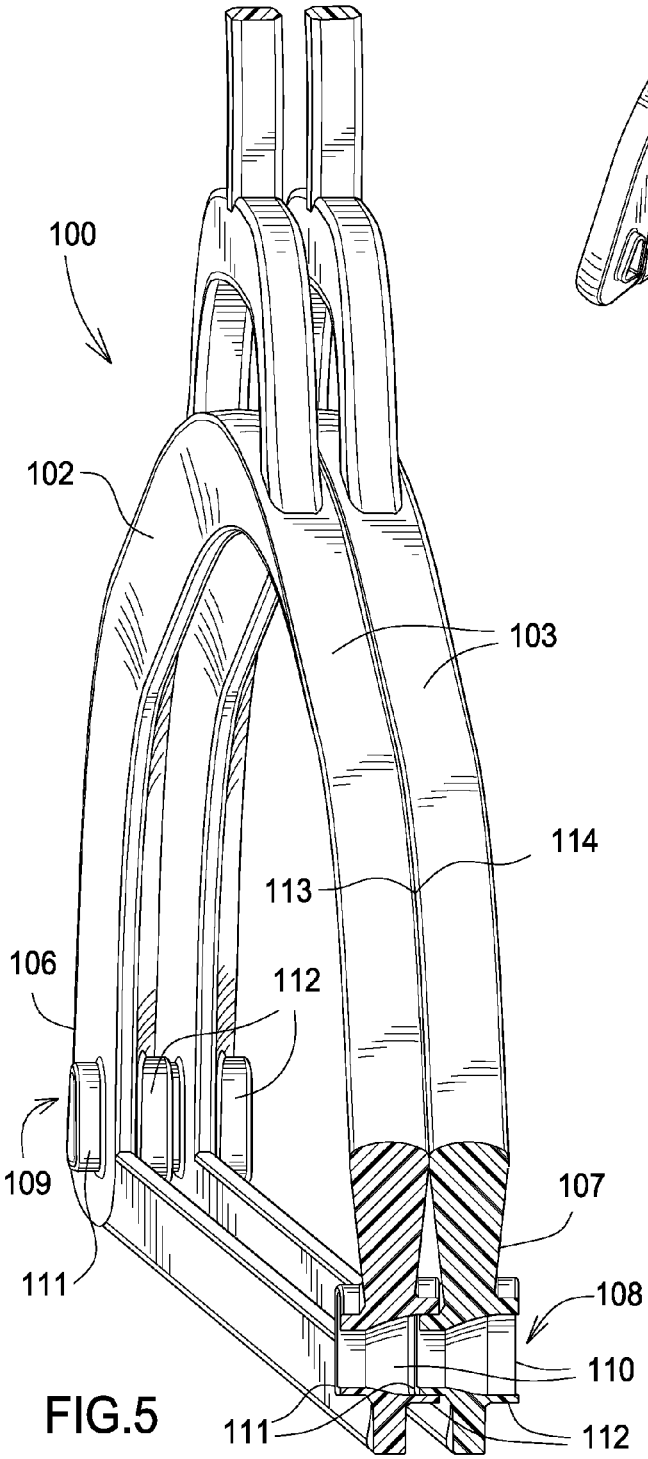
FIG. 5 is a cut away view of join hangers with the section take along line 4-4 of FIG. 3 removed.
Figure 6:
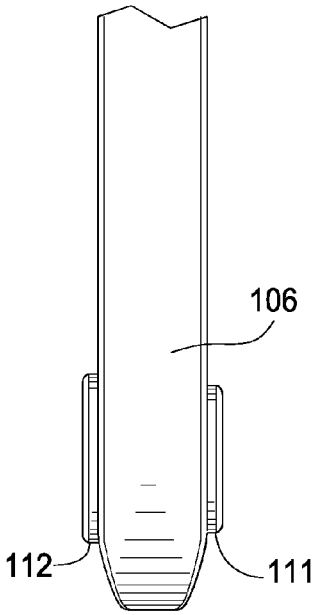
FIG. 6 is an end view of the interlocking region.

The lower ends 106, 107 have interlocking regions 108, 109 that allow two hangers 100 to be attached together as shown in FIG. 2 through 5. As seen in FIG. 1, the interlocking regions 108 and 109 are shaped as rounded triangles in the depicted embodiment. This shape was chosen for is ascetic appearance. As is best seen in FIGS. 4 and 6, each depicted interlocking region has an interior cavity 110, which in the depicted embodiment extends all the way through the body of the hanger as seen in FIGS. 4 and 5. Other embodiments (not shown) could have opposition recesses on each side.

Figure 2:
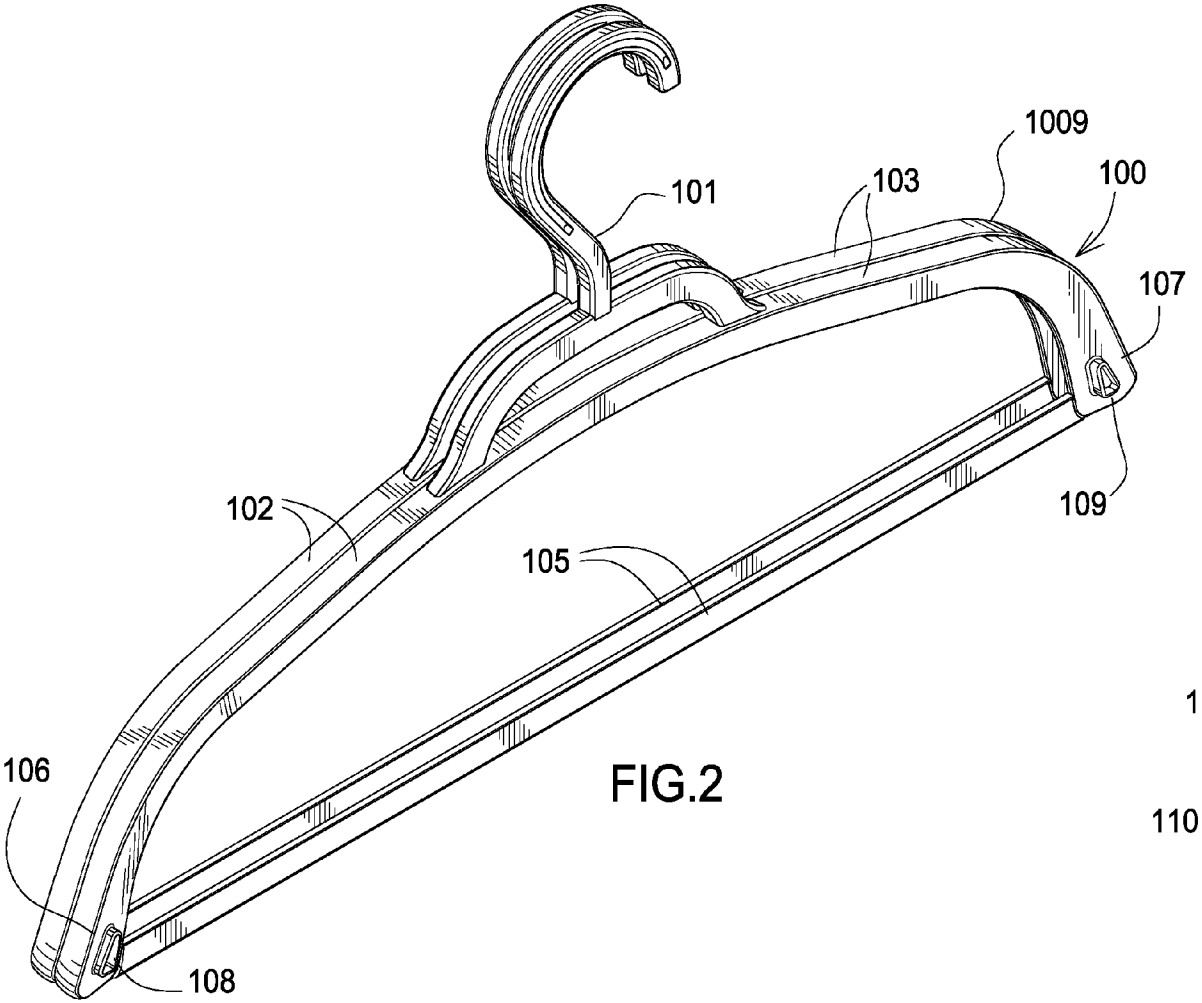
FIG. 2 is a front isometric view of two hangers locked together at the interlocking region.

On each side of the hanger a first lip 111 and second lip 112 extend from the body of the hanger around the interior cavity. The interior cavity 110 tapers from one side to the other, such that lip 111 has a smaller circumference than 112. Lip 111 is sized such that it friction fits into the interior of lip 112 as seen in FIGS. 4 and 5. In the depicted embodiment, the lower end 106, 107 are narrower in width than the rest of the body of the hanger, such that the side surfaces 113, 114 are flush with each other when the hangers are interlocked as shown in FIGS. 2 and 2 and 5. Other configurations of the interlocking regions could be used as well to allow this interlock. The exact appearance of the depicted interlocking regions is ornamental. The depicted interlocking regions 108, 109 allow any number of hanger 100 to be locked together in a string (not shown) to allow the user to create as wide of hanging surface as needed. Locking two or more hangers 100 together also creates a stronger hanger that can hold heavier items without bending. The formation of the interlocking regions in the depicted embodiment also means that the interlocking regions does not extend beyond the plane of the upper arms, both allowing the hangers to fit closely together in both transport and during use, saving room. This also reduces the likelihood that the interlocking regions will cause any wrinkles in the items hanging on them.

Figure 7:
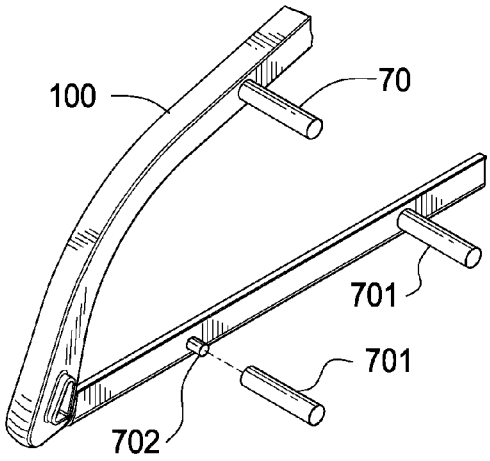
FIG. 7 is a close up partially exploded view of a first type of joining piece.
Figure 8:
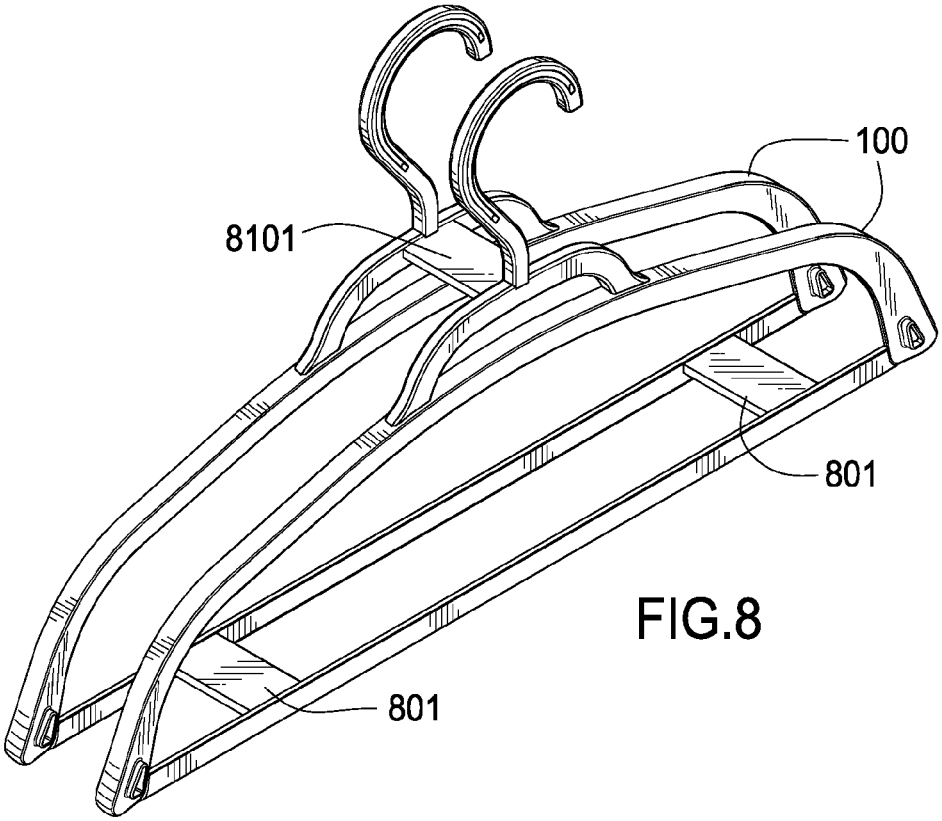
FIG. 8 is front perspective view of two hangers locked together with a second type of joining pieces.

Referring next to FIG. 7, in addition to and/or instead of, joining pieces can be used to connect hangers 100. In the depicted embodiment hollow tubes 701 fit over aligning pegs 702 on each hanger to attach hangers together. FIG. 8 shows another embodiment, where hollow rectangles 801 are used to attach the hangers 100 instead of the tubes 701.

Figure 9:
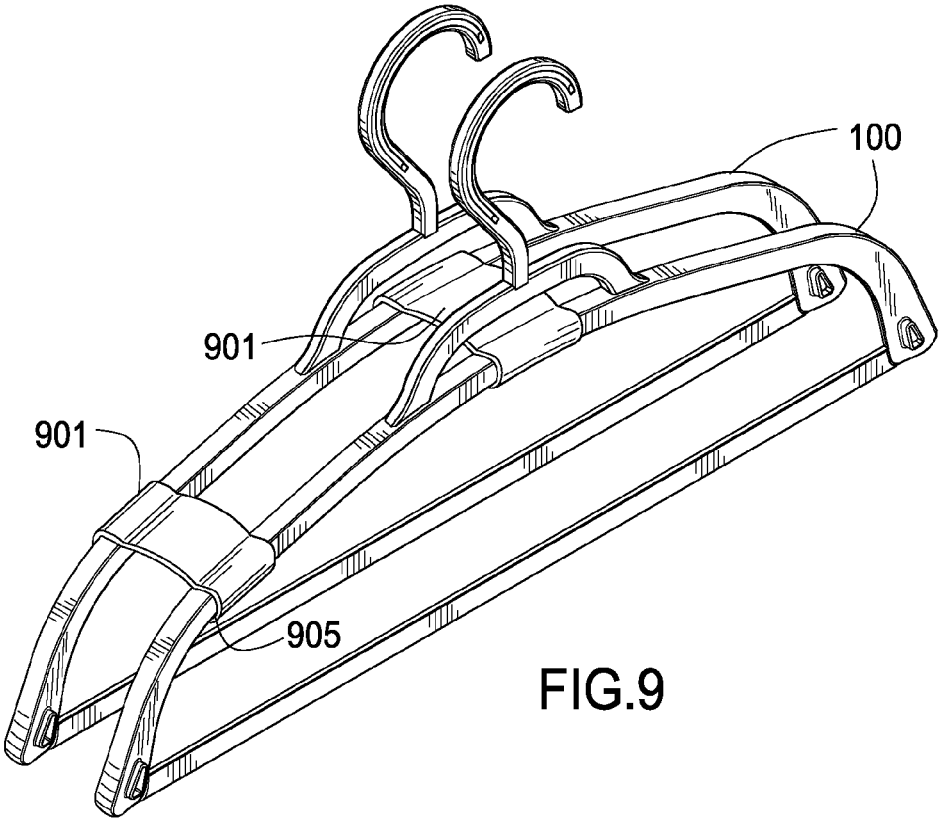
FIG. 9 is front perspective view of two hangers locked together with a third type of joining pieces.
Figure 10:
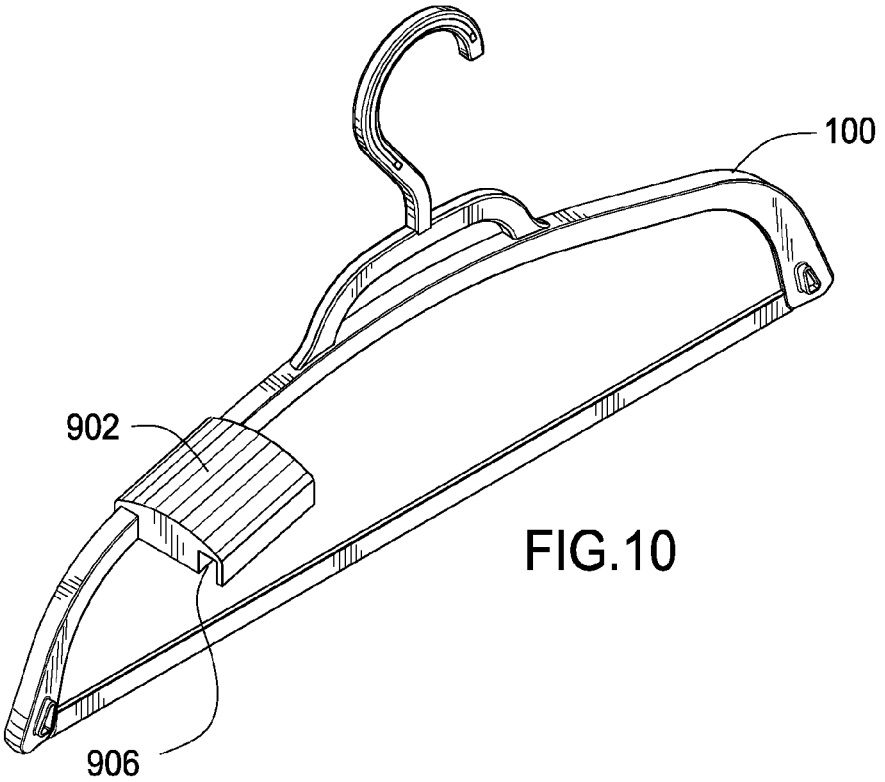
FIG. 10 is a front perspective view of a hanger with a fourth type of joining piece mounted on it.
Figure 11:
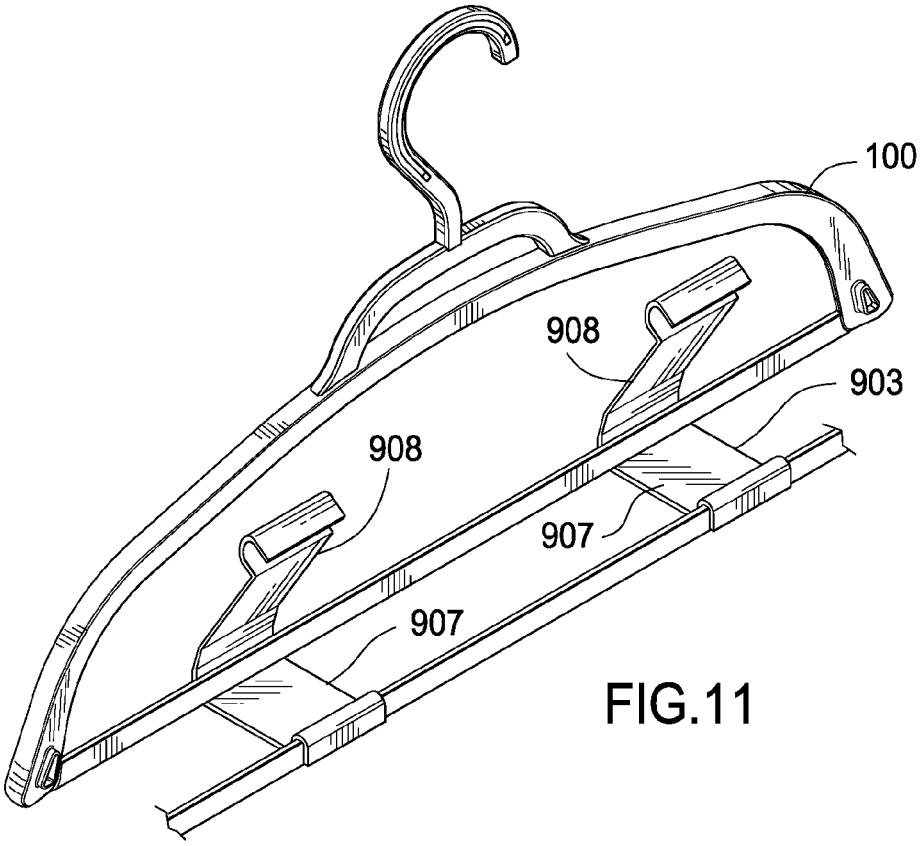
FIG. 11 is a partially exploded view of a fifth type of joining piece.

FIGS. 9, 10 and 11 show various joining pieces that are formed to snap on to the hanger 100. Joining pieces 901 and 902 have groove 905, 906 that friction fit over the upper arms of the hanger. Connection pieces 903 have upper and lower sections 907, 908, that snap together, joining the hangers together.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

We claim:

1. An interlocking hanger comprising:

a rail hook attached to opposed two upper arms, each upper arm extending in an arc down to a lower end;

the lower end of each of said upper arms having an attachment region, said attachment region configured such that it can interlock with a substantially identical attachment region on another hanger, attaching two interlocking hangers together;

on the opposing first and second sides of the attachment region, said first side interlocks with said second side; and wherein the first and second sides each further comprise a lip extending away from the first and second sides, the first lip having a smaller circumference than the second lip.

2. The interlocking hanger of claim 1 further comprising each lip surrounding and extending from a recess.

3. The interlocking hanger of claim 2 further comprising the two recess joining together to form an interior cavity that extends through the body of the hanger.

4. The interlocking hanger of claim 1 wherein the first lip is sized such that it friction fits into an interior of the second lip.

5. The interlocking hanger of claim 1 wherein the body and the attachment regions each have a width, the attachment regions having a smaller width than the rest of the body of the hanger, such that side surfaces are substantially flush with each other when two hangers are interlocked.

6. The interlocking hanger of claim 1, further comprising a second interlocking hanger wherein the attachment region of the interlocking hanger is substantially identical to an interlocking region of the second hanger and the interlocking region of the first interlocking hanger can interlock with an interlocking region of the second hanger with no further components needed.

* * * * *